US010724553B2

(12) United States Patent
Zammuto

(10) Patent No.: US 10,724,553 B2
(45) Date of Patent: Jul. 28, 2020

(54) THREE POSITION METERING VALVE FOR A SELF-CONTAINED ELECTRO-HYDRAULIC ACTUATOR

(71) Applicant: Warner Electric Technology LLC, Braintree, MA (US)

(72) Inventor: Jared Ret Zammuto, Caledonia, IL (US)

(73) Assignee: Warner Electric Technology LLC, Braintree, MA (US)

( * ) Notice: Subject to any disclaimer, the term of this patent is extended or adjusted under 35 U.S.C. 154(b) by 14 days.

(21) Appl. No.: 16/211,764

(22) Filed: Dec. 6, 2018

(65) Prior Publication Data

US 2020/0182266 A1 Jun. 11, 2020

(51) Int. Cl.

| | |
|---|---|
| ***F15B 11/05*** | (2006.01) |
| ***F15B 11/042*** | (2006.01) |
| ***F15B 13/02*** | (2006.01) |
| ***F15B 15/14*** | (2006.01) |

(52) U.S. Cl.

CPC ..... *F15B 11/05* (2013.01); *F15B 11/0426* (2013.01); *F15B 13/027* (2013.01); *F15B 13/028* (2013.01); *F15B 15/14* (2013.01)

(58) Field of Classification Search

CPC ..... F15B 11/05; F15B 15/14; F15B 13/027; F15B 11/0426; F15B 13/028; F15B 2211/3052

See application file for complete search history.

(56) References Cited

U.S. PATENT DOCUMENTS 2,457,467 A 12/1948 Hartman
3,481,275 A 12/1969 Gelin
4,551,973 A * 11/1985 Broadhead ..... F15B 15/18 60/477

(Continued)

FOREIGN PATENT DOCUMENTS

EP 0032300 A1 7/1981
JP H02-255005 A 10/1990

(Continued)

OTHER PUBLICATIONS

English translation of JP H02-255005.

(Continued)

*Primary Examiner* — Thomas E Lazo
(74) *Attorney, Agent, or Firm* — Reising Ethington P.C.

(57) ABSTRACT

A fluid pump for a linear actuator causes a rod in the actuator to extend or retract by controlling fluid flow to and from portions of a fluid chamber on either side of a piston disposed within the fluid chamber and supporting the rod. The pump includes check valves that control fluid flow between a driven pump element and each portion of the fluid chamber and a shuttle movable in response to fluid pressure along a shuttle axis extending through the valves. At least one valve includes a valve member movable between a closed position and an open position defining a fluid flow path between the driven pump element and fluid chamber and means for limiting movement of the shuttle towards the valve such that the shuttle may, depending on the position of the limiting means, move the valve member to an intermediate position between the closed and open positions.

21 Claims, 4 Drawing Sheets

(56) References Cited

U.S. PATENT DOCUMENTS

| | | | | |
|---|---|---|---|---|
| 4,669,494 | A * | 6/1987 | McBeth | F15B 7/06 137/106 |
| 4,745,845 | A | 5/1988 | Legris et al. | |
| 5,032,094 | A * | 7/1991 | Katogi | B63H 20/10 440/53 |
| 5,535,663 | A | 7/1996 | Yamashita et al. | |
| 6,152,715 | A | 11/2000 | Kaempe et al. | |
| 6,519,939 | B1 | 2/2003 | Duff | |
| 6,979,185 | B2 | 12/2005 | Kaempe | |
| 7,249,458 | B2 | 7/2007 | Arbel et al. | |
| 7,281,372 | B2 | 10/2007 | Sakai et al. | |
| 8,100,145 | B2 | 1/2012 | Desbois-Renaudin | |
| 8,578,838 | B2 * | 11/2013 | Davidson | F15B 7/001 91/420 |
| 8,851,944 | B1 * | 10/2014 | Wiatrowski | B63H 20/08 440/61 A |
| 9,500,206 | B2 * | 11/2016 | Zammuto | F15B 13/027 |
| 10,288,064 | B2 * | 5/2019 | Zammuto | F15B 13/027 |
| 2008/0022672 | A1 | 1/2008 | He | |
| 2010/0193714 | A1 | 8/2010 | Hankinson et al. | |
| 2010/0242718 | A1 | 9/2010 | Willauer et al. | |
| 2010/0300279 | A1 | 12/2010 | Kadlicko et al. | |
| 2012/0220177 | A1 | 8/2012 | Tsutsui et al. | |
| 2015/0144212 | A1 | 5/2015 | Matsuo et al. | |
| 2016/0153474 | A1 | 6/2016 | Anderson | |
| 2018/0134106 | A9 | 5/2018 | Anderson et al. | |

FOREIGN PATENT DOCUMENTS

| | | | |
|---|---|---|---|
| JP | 2006-200598 | A | 3/2006 |
| JP | 2006-105226 | A | 4/2006 |
| JP | 2006-105227 | A | 4/2006 |
| JP | 2013-024383 | A | 2/2013 |
| WO | 2015/080883 | A1 | 6/2015 |

OTHER PUBLICATIONS

English translation of JP2006-105226.
English translation of JP2006-105227.
English translation of JP2006-200598.
English translation of JP2013-024383.
International Search Report issued in corresponding International (PCT) Patent Application No. PCT/US2019/064572 (Mar. 11, 2020).
Written Opinion issued in corresponding International (PCT) Patent Application No. PCT/US2019/064572 (Mar. 11, 2020).

* cited by examiner

THREE POSITION METERING VALVE FOR A SELF-CONTAINED ELECTRO-HYDRAULIC ACTUATOR

BACKGROUND OF THE INVENTION a. Field of the Invention

This disclosure relates to a fluid pump for a linear actuator. In particular, the instant disclosure relates to a fluid pump with an improved valve structure for controlling fluid flow between the actuator and fluid pump and metering fluid flow returning from the actuator to the fluid pump.

b. Background Art

In a fluid controlled linear actuator, a double acting piston is disposed within a fluid chamber and connected to an actuator rod extending from the fluid chamber. Fluid is delivered to and removed from the fluid chamber on opposite sides of the piston in order to move the piston within the chamber and extend or retract the rod. Fluid is delivered to and removed from the fluid chamber using a fluid pump.

Linear actuators are frequently used to move loads that are influenced by gravitational forces. In situations where the linear actuator exerts a force in the same direction as the gravitational force, fluid flow may exceed the maximum flow rate of the fluid pump in the actuator and cause pressure chatter or bounce resulting in pressure spikes that exceed relief valve settings in the pump and uncontrolled movement of the load. These conditions can be mitigated by metering fluid flow from the fluid chamber in the actuator to the pump. Conventional methods for metering fluid flow, however, all have significant drawbacks. Orifice plates have relatively small openings that are easily clogged. Further, the plates experience localized heating while metering fluid flow that can impact the rate of metering. Adjustable needle valves require the creation of an additional fluid flow path and lack a closed position. Counterbalance valves require relatively large amounts of space and are relatively expensive.

The inventor herein has recognized a need for a fluid pump for a linear actuator that will minimize and/or eliminate one or more of the above-identified deficiencies.

BRIEF SUMMARY OF THE INVENTION

An improved fluid pump for a linear actuator is provided. In particular, a fluid pump is provided having an improved valve structure for controlling fluid flow between the actuator and fluid pump and metering fluid flow returning from the actuator to the fluid pump.

A fluid pump for a linear actuator in accordance with one embodiment includes a housing defining an inlet port configured for fluid communication with a fluid reservoir and first and second outlet ports configured for fluid communication with first and second portions of a fluid chamber formed on opposite sides of a piston disposed within the fluid chamber. The fluid pump further includes a driven pump element disposed within the housing. The fluid pump further includes a first check valve configured to control fluid flow between the driven pump element and the first outlet port, a second check valve configured to control fluid flow between the driven pump element and the second outlet port, and a shuttle disposed between the first check valve and the second check valve and movable along a shuttle axis extending through the first check valve and the second check valve responsive to fluid pressure in the housing. The first check valve includes a valve member movable between a closed position and an open position defining a fluid flow path between the driven pump element and the first outlet port and a pin extending along the shuttle axis through a bore in the first valve member and configured for engagement with the shuttle. Rotation of the driven pump element in a first rotational direction establishes a first fluid pressure causing the valve member to move from the closed position to the open position. Rotation of the driven pump element in a second rotational direction establishes a second fluid pressure causing the shuttle to move the valve member from the closed position to one of the open position and an intermediate position between the closed position and the open position responsive to a position of the pin along the shuttle axis.

A fluid pump for a linear actuator in accordance with another embodiment includes a housing defining an inlet port configured for fluid communication with a fluid reservoir and first and second outlet ports configured for fluid communication with first and second portions of a fluid chamber formed on opposite sides of a piston disposed within the fluid chamber. The fluid pump further includes a driven pump element disposed within the housing. The fluid pump further includes a first check valve configured to control fluid flow between the driven pump element and the first outlet port, a second check valve configured to control fluid flow between the driven pump element and the second outlet port, and a shuttle disposed between the first check valve and the second check valve and movable along a shuttle axis extending through the first check valve and the second check valve responsive to fluid pressure in the housing. The first check valve includes a valve member movable between a closed position and an open position defining a fluid flow path between the driven pump element and the first outlet port and means for limiting movement of the shuttle in a first direction along the shuttle axis towards the first check valve. Rotation of the driven pump element in a first rotational direction establishes a first fluid pressure causing the valve member to move from the closed position to the open position. Rotation of the driven pump element in a second rotational direction establishes a second fluid pressure causing the shuttle to move in the first direction along the shuttle axis and move the valve member from the closed position to one of the open position and an intermediate position between the closed position and the open position responsive to a position of the limiting means along the shuttle axis A linear actuator in accordance with one embodiment includes a tube defining a fluid chamber, a piston disposed within the fluid chamber and a pushrod coupled to the piston for movement with the piston. The linear actuator further includes a fluid pump. The fluid pump includes a housing defining an inlet port configured for fluid communication with a fluid reservoir and first and second outlet ports configured for fluid communication with first and second portions of a fluid chamber formed on opposite sides of a piston disposed within the fluid chamber. The fluid pump further includes a driven pump element disposed within the housing. The fluid pump further includes a first check valve configured to control fluid flow between the driven pump element and the first outlet port, a second check valve configured to control fluid flow between the driven pump element and the second outlet port, and a shuttle disposed between the first check valve and the second check valve and movable along a shuttle axis extending through the first check valve and the second check valve responsive to fluid pressure in the housing. The linear actuator further includes a motor coupled to the driven pump element. The first check valve includes a valve member movable between a closed position and an open position defining a fluid flow path between the driven pump element and the first outlet port and a pin extending along the shuttle axis through a bore in the first valve member and configured for engagement with the shuttle. Rotation of the driven pump element in a first rotational direction establishes a first fluid pressure causing the valve member to move from the closed position to the open position. Rotation of the driven pump element in a second rotational direction establishes a second fluid pressure causing the shuttle to move the valve member from the closed position to one of the open position and an intermediate position between the closed position and the open position responsive to a position of the pin along the shuttle axis.

A fluid pump in accordance with the present teachings is advantageous relative to conventional fluid pumps for linear actuators. The valve structure of the fluid pump allows adjustment of fluid flow without adding or removing any parts in the pump. Pumps using orifice plates to meter fluid flow must be disassembled to exchange orifice plates of different sizes or to move the orifice plate in order to change the degree of metering of fluid flow. Further, unlike orifice plates, the valve structure of the fluid pump disclosed herein is able to maintain the size of the fluid flow path despite localized heating while meting fluid flow. The larger mass and surface area of the valve decreases the rate of heating and also reduces the amount of time required for transferring heat out of the valve. The bi-directional nature of the fluid pump disclosed herein also reduces or eliminates the potential for clogs to develop. Unlike adjustable needle valves, the valve structure of the fluid pump is able to meter fluid flow while maintaining a single fluid flow path. Finally, unlike counterbalance valves, the valve structure of the fluid pump requires relatively little space and is relatively inexpensive.

The foregoing and other aspects, features, details, utilities, and advantages of the present teachings will be apparent from reading the following description and claims, and from reviewing the accompanying drawings.

DETAILED DESCRIPTION OF EMBODIMENTS OF THE INVENTION

Figure 1:
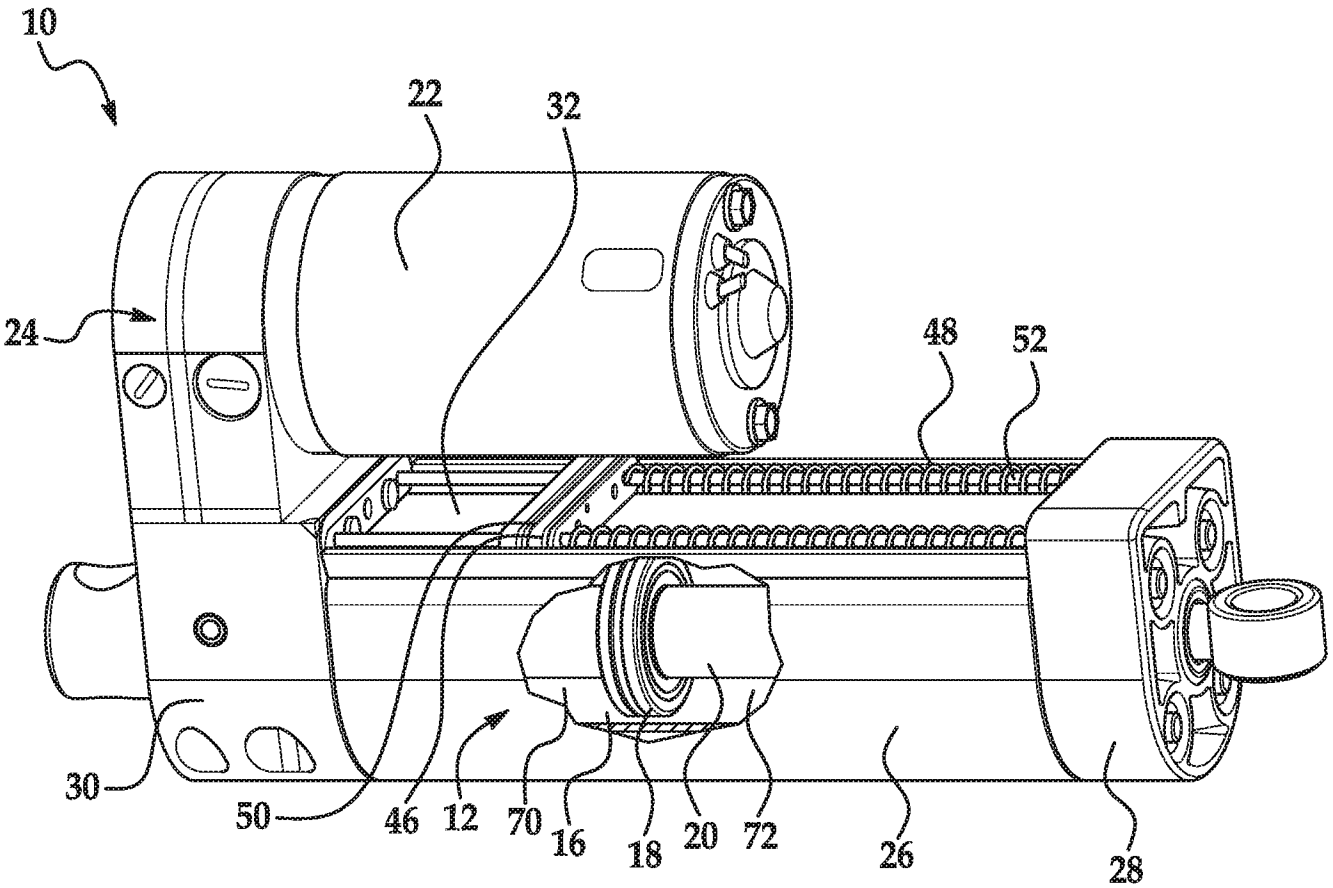
FIG. 1 is a perspective view of a linear actuator in accordance with one embodiment of the present teachings.
Figure 2:
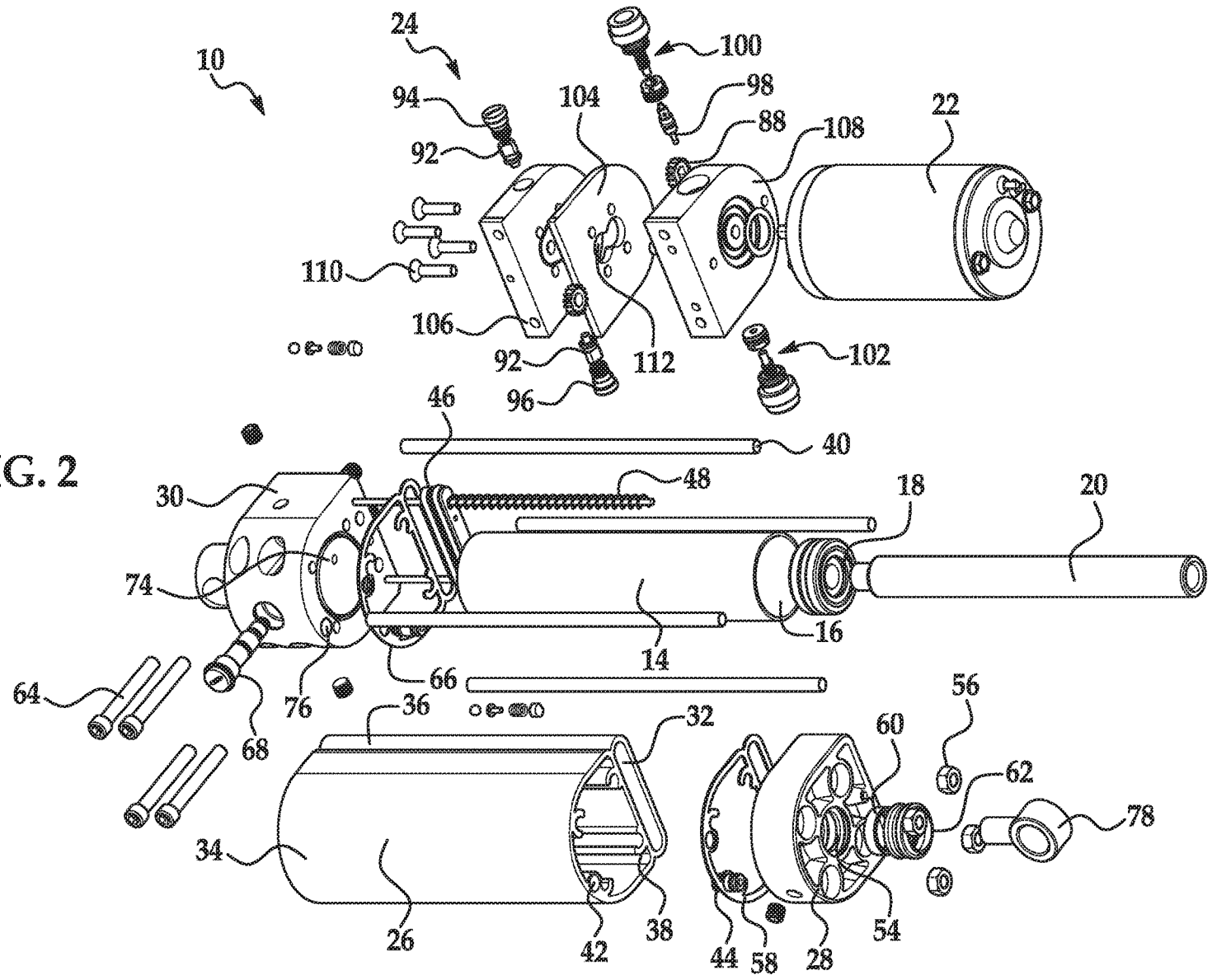
FIG. 2 is an exploded view of the actuator of FIG. 1.

Referring now to the drawings wherein like reference numerals are used to identify identical components in the various views, FIGS. 1-2 illustrate a linear actuator 10 in accordance with one embodiment of the present teachings. Actuator 10 is provided to move an object back and forth in a line along an axis. Actuator 10 may be used to push and pull an object or to lift and lower an object and may be used in a wide variety of applications including, for example, adjusting the height of vehicle components including seats and wheelchair lifts, adjusting the height of machine components including brushes and lawn mower decks and blades and positioning conveyor guides. It should be understood that the identified applications are exemplary only. Actuator 10 may include an actuator housing 12, a tube 14 defining a fluid chamber 16, a piston 18, a rod 20, a motor 22, and a pump 24 in accordance with the present teachings.

Housing 12 provides structural support to other components of actuator 10 and prevents damage to those components from foreign objects and elements. Housing 12 may also define a fluid manifold for routing fluid between pump 24 and actuator tube 14. Housing 12 may include a main body 26, a head 28 and an end cap 30.

Body 26 is provided to support actuator tube 14. Referring to FIG. 2, body 26 further defines a fluid reservoir 32 containing fluid that may be used in retracting and/or extending actuator 10. Body 26 may be made from conventional metals or plastics. Body 26 may be divided into two sections 34, 36. Section 34 may be substantially D-shaped in cross-section and may define a plurality of circumferentially spaced C-shaped receptacles 38 on a radially inner surface configured to receive tie rods 40. Tie rods 40 may be made from elastic materials and may have threads on either end for coupling to head 28 and end cap 30. Tie rods 40 clamp tube 14 between head 28 and end cap 30, but allow head 28 and end cap 30 to separate from tube 14 to relieve pressure if the pressure in tube 14 exceeds a predetermined threshold. Section 34 may further define a fluid conduit 42 extending along the length of section 34 and configured to deliver fluid to fluid chamber 16 on the rod side of piston 18. Conduit 42 may be coupled to fluid chamber 16 using a fluid coupler 44. Section 36 of body 26 may be substantially oval in cross-section and share a common wall with section 34. Section 36 may define fluid reservoir 32. By incorporating reservoir 32 with the other components of actuator 10, the overall size of the actuator 10 and, in particular, the overall length of actuator 10 may be reduced relative to conventional actuators. In accordance with one aspect of the present teachings, actuator 10 may include means, such as lid 46 and springs 48 for varying the volume of reservoir 32.

Lid 46 seals one end of fluid reservoir 32. Lid 46 is configured to be received within section 36 of body 26 and therefore may be substantially oval. It should be understood, however, that the shape of lid 46 may vary and is intended to be complementary to the shape of fluid reservoir 32 defined by section 36 of body 26. Referring to FIG. 1 (in which a portion of section 36 of housing 12 has been removed for clarity), lid 46 may include a fluid seal 50 disposed about lid 46 and configured to prevent fluid from leaking past lid 46 and to prevent entry of air and contaminants into the fluid. Lid 46 may define one or more bores extending therethrough that are configured to receive rods 52 extending through reservoir 32. Lid 46 is supported on rods 52 and may be configured to slide linearly along rods 52 to vary the position of lid 46 and the volume of fluid reservoir 32. Appropriate fluid seals may be disposed within the bores in lid 46 surrounding rods 52.

Springs 48 provide means for biasing lid 46 in one direction. Springs 48 may be disposed about and supported on rods 52. One end of each spring 48 engages and is seated against a side of lid 46 while the opposite end may engage and be seated against a surface of head 28 at the end of reservoir 32. Springs 48 apply a relatively small biasing force to lid 46 sufficient to cause movement of lid 46 in the absence of fluid pressure or a reduction in fluid pressure in reservoir 32 and which may yield to increasing fluid pressure in the fluid in the reservoir 32.

The use of lid 46 and springs 48 provides several advantages relative to conventional actuators. For example, lid 46 and springs 48 allow the volume of the fluid reservoir 32 to vary. As a result, actuator 10 is able to handle changing fluid volumes resulting from varying displacement of fluids during extension and retraction of rod 20 in the actuator 10 as well as from thermal expansion and contraction of the fluid. The variable volume reservoir 32 also permits variation in stroke length for the actuator without the need to change the size of the reservoir housing. Springs 48 also protect against pump cavitation by transferring pressure to the fluid in reservoir 32. Further, because the spring-loaded lid 46 seals the fluid in reservoir 32 from the atmosphere regardless of orientation of actuator 10, lid 46 and springs 48 facilitate mounting of actuator 10 in a wider variety of orientations than conventional actuators including those in which gravity acting on the fluid would otherwise risk atmospheric contamination of the fluid in conventional actuators.

Referring again to FIG. 2, head 28 closes one longitudinal end of body 26 and provides an aperture 54 through which actuator rod 20 may be extended or retracted. Head 28 may also support tie rods 40 near one longitudinal end of each tie rod 40. Tie rods 40 may extend through bores in head 28 and be secured in place using nuts 56 and washers. A gasket 58 may be disposed between head 28 and body 26 to prevent fluid leakage from housing 12 as well as entry of contaminants. A wiper 60 and seals 62 may be placed within aperture 54 in order to prevent fluid leakage during extension of actuator rod 20.

End cap 30 closes the opposite longitudinal end of body 26 relative to head 28 and may support the opposite longitudinal end of each tie rod 40 relative to head 28. End cap 30 may be secured to pump 24 using conventional fasteners such as socket head cap screws 64. End cap 30 may also define at least part of a fluid manifold for transferring fluid between pump 24 and tube 14. A gasket 66 may be disposed between end cap 30 and body 26 to prevent fluid leakage from housing 12 as well as entry of contaminants. A manual release mechanism 68 may be received within end cap 30 and used to release actuator 10 in the event of a mechanical failure. Mechanism 68 may comprise a threaded needle having seals disposed about the needle. During normal operation of actuator 10, when the needle and seals are fully seated within end cap 30, mechanism 68 inhibits fluid communication among conduits leading to fluid chamber 16 and reservoir 32. Rotation of mechanism 68 unseats the needle and seals and establishes fluid communication between the conduits to relieve pressure within actuator 10 and permit manual retraction or extension of rod 20.

Tube 14 is configured to house piston 18 and at least a portion of rod 20 and defines a fluid chamber 16 in which piston 18 is disposed. Tube 14 may be cylindrical in shape and is configured to be received within body 26 of housing 12 and supported on tie rods 40 within housing 12. Referring again to FIG. 1, the fluid chamber 16 in tube 14 may be divided by piston 18 into two portions 70, 72 with one portion 70 on the rodless side of piston 18 and the other portion 72 on the rod side of piston 18. Referring again to FIG. 2, portion 70 of fluid chamber 16 may be in fluid communication with a port 74 formed in end cap 30 of housing 12. Portion 72 may be in fluid communication with fluid conduit 42 extending from another port 76 in end cap 30 and through body 26. Fluid may be introduced to and/or removed from each portion 70, 72 of chamber 16 as described hereinbelow to move piston 18 within the chamber 16 and extend or retract rod 20.

Piston 18 supports one longitudinal end of rod 20 and moves within fluid chamber 16 of tube 14 responsive to fluid pressure within chamber 16 to extend or retract rod 20. Piston 18 is circular in the illustrated embodiment. It should be understood, however, that the shape of piston 18 may vary and is intended to be complementary to tube 14. One or more fluid seals may be disposed about piston 18 to prevent fluid leakage between portions 70,72 of fluid chamber 16.

Rod 20 causes linear motion in another object (not shown). One longitudinal end of rod 20 is coupled to piston 18. The opposite longitudinal end of rod 20 may be configured as, or may support, a tool 78. It should be understood that the configuration of tool 78 may vary depending on the application of actuator 10.

Motor 22 is provided to drive pump 24 in order to displace liquid within tube 14 and extend or retract rod 20. Motor 22 may comprise an electric motor such as an alternating current motor with a stator and rotor or a brushed or brushless direct current motor. Motor 22 is coupled to pump 24 and may be orientated longitudinally in a direction parallel to actuator housing 12.

Pump 24 is provided to transfer and distribute fluid among reservoir 32 and portions 70, 72 of fluid chamber 16. Referring to FIG. 3-6, pump 24 may include a housing 80 defining an inlet port 82 and outlet ports 84, 86 and driven and idler gears 88, 90. In accordance with certain embodiments and aspects of the invention, pump 24 may further include, means, such as shuttle 92 and springs 94, 96 for controlling fluid flow between inlet port 82 and gears 88, 90, and means, such as shuttle 98 and check valves 100, 102, for controlling fluid flow between gears 88, 90 and outlet ports 84, 86.

Housing 80 provides structural support to other components of pump 24 and prevents damage to those components from foreign objects and elements. Housing 80 may include several members including gear housing member 104, inlet housing member 106 and outlet housing member 108. Referring to FIG. 2, housing members 104, 106, 108 may be coupled together using conventional fasteners 110 and may include fluid seals between adjacent members 104, 106, 108 to prevent fluid leakage.

Gear housing member 104 may be disposed between inlet and outlet housing members 106, 108. Member 104 defines a cavity 112 in the shape of two circles that open into another to form a substantially peanut shaped opening. Cavity 112 is configured to receive driven and idler gears 88, 90 and to allow teeth on gears 88, 90 to engage one another.

Figure 3:
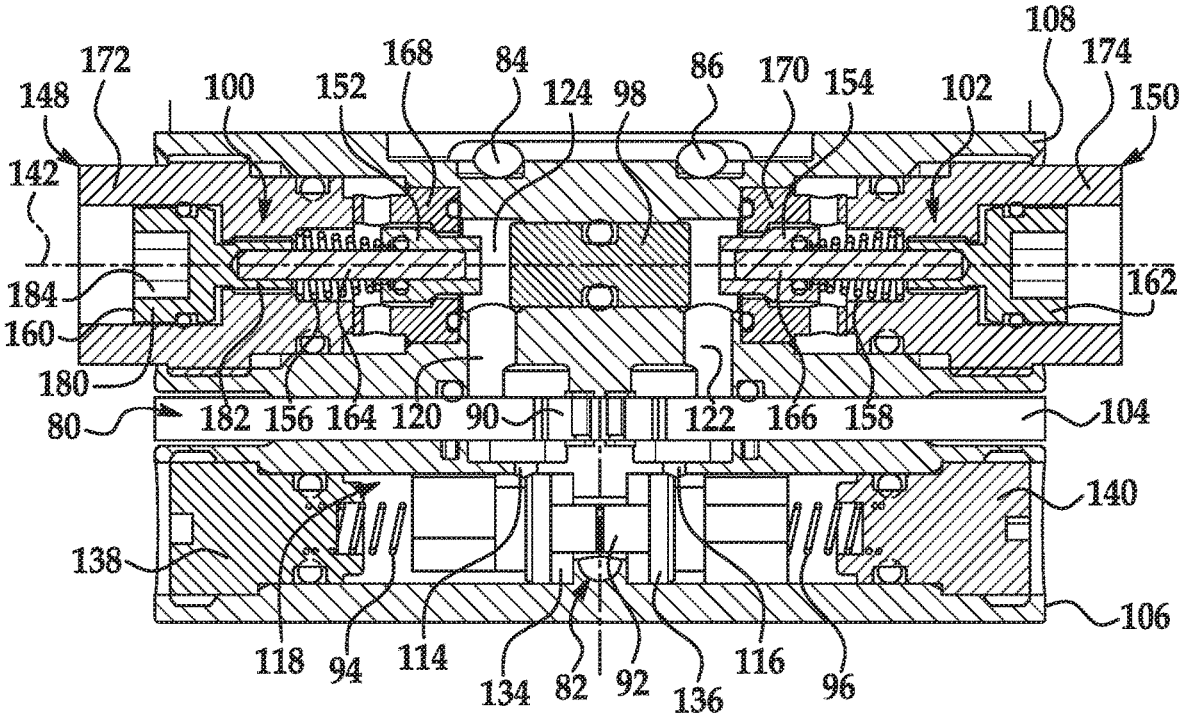
FIG. 3 is a cross-sectional view of a fluid pump in accordance with one embodiment of the present teachings illustrating the fluid pump with the actuator at rest.

Inlet housing member 106, together with end cap 30 of housing 12, defines a fluid manifold for directing fluid between fluid reservoir 32 and gears 88, 90. Referring to FIG. 3, housing member 106 defines inlet port 82 that is configured for fluid communication with reservoir 32 and a pair of pump ports 114, 116, that are in fluid communication with cavity 112 in gear housing member 104. Member 106 further defines a passageway 118 extending across member 106 configured to receive shuttle 92 and springs 94, 96.

Outlet housing member 108, together with end cap 30 of housing 12, defines a fluid manifold for directing fluid between gears 88, 90 and tube 14. Member 108 defines outlet ports 84, 86 that are configured for fluid communication with portions 70, 72 of fluid chamber 16 and a pair of conduits 120, 122 that are in fluid communication with cavity 112 in gear housing member 104. Member 108 further defines a passageway 124 extending across member 108 configured to receive shuttle 98 and check valves 100, 102.

Figure 4:
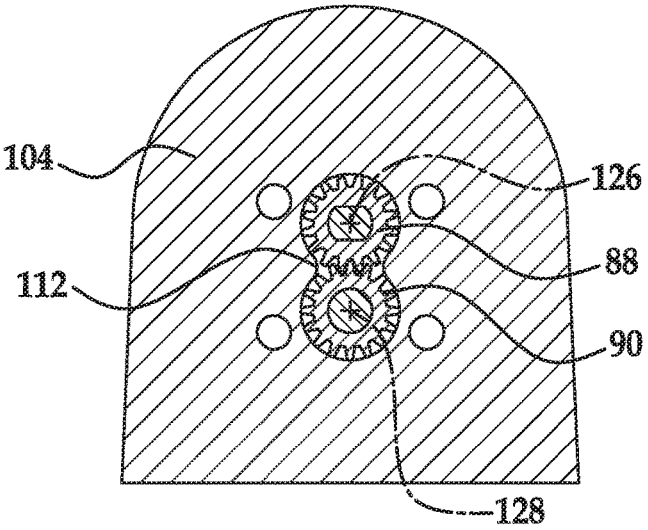
FIG. 4 is a plan view of a portion of a fluid pump in accordance with one embodiment of the present teachings.

Referring to FIG. 4, driven and idler gears 88, 90 comprise a gear pump that creates fluid pressure within pump 24 and actuator 10 to cause movement of piston 18 and extension or retraction of rod 20. Gears 88, 90 may be made from conventional metals and metal alloys or plastics. Gears 88, 90 are disposed within housing 80 and, in particular, within cavity 112 in gear housing member 104. Driven and idler gears 88, 90 are configured for rotation about parallel axes 126, 128. Driven gear 88 is supported on a shaft (not shown) extending from motor 22 and may be driven by motor 22 in either rotational direction. Idler gear 90 is supported on a parallel shaft (e.g., a dowel pin), is in mesh with driven gear 88, and rotates responsive to rotation of driven gear 88. Driven and idler gears 88, 90 rotate in opposite rotational directions and draw fluid from one side of pump 24 to the other side of pump 24. It should be understood that driven and idler gears 88, 90 are exemplary pump elements only and that other conventional pump forms could be implemented. Thus, while the pump may comprise an external gear pump having gears 88, 90 with gear 88 comprising the driven pump element, the pump may alternatively comprise, for example, a gerotor pump with the inner gear comprising a driven pump element or a radial ball piston pump with an eccentric drive shaft comprising the driven pump element.

Referring again to FIG. 3, shuttle 92 and springs 94, 96 provide means for controlling fluid flow between inlet port 82 and gears 88, 90. Shuttle 92 and springs 94, 96 are disposed on one axial side of gears 88, 90. Shuttle 92 is movable between a fluid flow position permitting fluid flow between inlet port 82 and gears 88, 90 along a fluid flow path 130 (FIG. 5) and a fluid flow position permitting fluid flow between inlet port 82 and gears 88, 90 along a fluid flow path 132 (FIG. 6) and a neutral position (FIG. 3) between the two fluid flow positions inhibiting fluid flow along both of paths 130, 132. Shuttle 92 may comprise a split shuttle (see FIG. 2) that is symmetrical in shape. Shuttle 92 may include enlarged portions 134, 136 equidistant from a longitudinal center of shuttle 92. Each portion 134, 136 of shuttle 92 may define a labyrinth seal formed in a surface of portion 134, 136 and configured to mate to a surface of inlet housing member 106 to inhibit fluid flow along paths 130, 132 when shuttle 92 is in the neutral position. Springs 94, 96 are disposed on opposite sides of shuttle 92 and bias shuttle 92 to the neutral position. Springs 94, 96 apply equal and opposing forces to shuttle 92. One end of each spring 94, 96 engages a corresponding end of shuttle 92. The opposite end of each spring 94, 96 is seated in a recess in a corresponding sealed plug 138, 140 disposed within passage 118 of inlet housing member 106.

Shuttle 98 and check valves 100, 102 provide means for controlling fluid flow between gears 88, 90, and outlet ports 84, 86. Shuttle 98 and check valves 100, 102 are disposed on an opposite axial side of gears 88, 90 relative to shuttle 92 and springs 94, 96. Shuttle 98 is disposed between check valves 100, 102 and is movable along a shuttle axis 142 extending through shuttle 98 and valves 100, 102 in response to fluid pressure within housing 80. In the absence of fluid pressure in either of conduits 120, 122 (e.g., when gears 88, 90 are not rotating), shuttle 102 may occupy a neutral position (shown in FIG. 3) between check valves 100, 102 and check valves 100, 102 may remain closed to inhibit fluid flow between outlet ports 84, 86 and gears 88, 90. In the presence of fluid pressure within conduit 120 or 122 (depending on the direction of rotation of gears 88, 90), shuttle 102 moves along axis 142 between a fluid flow position permitting fluid flow between outlet ports 84, 86 and gears 88, 90 along fluid flow paths 144, 146 (FIG. 5) and another fluid flow position permitting fluid flow between outlet ports 84, 86 and gears 88, 90 along fluid flow paths 144, 146 (FIG. 6). In each fluid flow position, shuttle 102 applies a force to a corresponding check valve 100, 102 to open the check valve 100, 102 as discussed in greater detail below. Shuttle 98 may be symmetrical in shape with both longitudinal ends of shuttle 98 configured to engage a corresponding check valve 100, 102 upon movement away from the neutral position of shuttle 98.

Check valves 100, 102 may be substantially similar in construction. Check valves 100, 102 and may each include a valve body 148, 150, a valve member 152, 154, a spring 156, 158, a pedestal 160, 162 and means, such as pins 164, 166, for limiting movement of shuttle 98 along the shuttle axis 142 towards check valves 100, 102.

Figure 7:
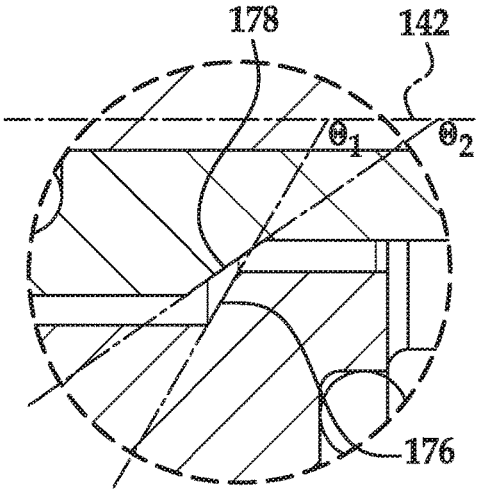
FIG. 7 is an enlarged detailed view of a portion of FIG. 5.

Valve bodies 148, 150 may each comprise two members 168, 170 and 172, 174, respectively, sized to be received within passage 124 of outlet housing member 108. Members 168, 170 define fluid passageways that form a part of fluid paths 144, 146 and connect conduits 120, 122 and outlet ports 84, 86. Members 168, 170 are annular in shape and each of members 168, 170 defines a through bore that may be disposed about, and centered about, shuttle axis 142. Referring to FIG. 7, the bores may vary in diameter to define shoulders 176 that act as valve seats for valve members 152, 154 and that slope at an angle $\theta_1$ of between zero and ninety degrees relative to axis 142 for a purpose described below. Referring again to FIGS. 3 and 5-6, members 168, 170 are configured to receive valve members 152, 154 therein. Members 172, 174 plug either end of passageway 124 in outlet housing member 108. Members 172, 174 may be threaded into outlet housing member 108 and a fluid seal may be disposed between each of members 172, 174 and outlet housing member 108. Members 172, 174 each define a through bore that may be disposed about, and centered about, shuttle axis 142. The bores may vary in diameter with an outboard portion having the greatest diameter and configured to receive one end of a corresponding pedestal 160, 162, an inboard portion have a smaller diameter than the outboard portion and configured to receive a corresponding spring 156, 158 and a portion of a corresponding pin 164, 166, and an intermediate portion having the smallest diameter and configured to receive another portion of a corresponding pedestal 160, 162 and another portion of a corresponding pin 164, 166. The difference in diameter between the inboard and intermediate portions of the bore defines a shoulder that acts as a spring seat for a corresponding spring 156, 158. The intermediate portion of the bore may further define a plurality of threads for a purpose discussed below.

Valve members 152, 154, open and close fluid flow paths 144, 146. The position of valve members 152, 154 along axis 142 determines whether flow paths 144, 146 are opened or closed and the size of the flow path 144, 146. Valve members 152, 154 are annular in shape and each of members 152, 154 defines a through bore that may be disposed about, and centered about, shuttle axis 142. The bores are sized to receive pins 164, 166. An outboard portion of each bore has a larger diameter configured to receive a fluid seal. The outboard portions of valve members 152, 154 also acts as spring seats for one end of a corresponding spring 156, 158 surrounding the pin 164, 166. Referring to FIG. 7, the outer diameter of each valve member 152, 154 varies to define a shoulder 178 configured to engage a corresponding shoulder 176 in member 168, 170 of valve body 148, 150 and prevent fluid flow along paths 144, 146 when check valves 100, 102 are closed. Shoulders 178 slope at an angle $\theta_2$ that is between zero and ninety degrees relative to axis 142 and that differs from the angle $\theta_1$ of shoulders 176. Valve members 152, 154 are configured to assume a closed position in which shoulders 176, 178 contact one another and close fluid flow paths 144, 146 to prevent fluid flow along paths 144, 146 and an open position in which shoulders 176, 178 are spaced from one another by a predetermined maximum distance to permit maximum fluid flow through fluid flow paths 144, 146. In accordance with the present teachings, one or both of valve members 152, 154 may also assume one or more intermediate positions in which shoulders 176, 178 are spaced from one another by a distance that is less than the predetermined maximum distance between shoulders 176, 178 when in the open position. When valve members 152, 154 are in any of the intermediate position, fluid may flow through fluid flow paths 144, 146, but at a reduced rate such that the fluid flow through paths 144, 146 is metered.

Springs 156, 158 bias valve members 152, 154 to a closed position. Springs 156, 158 are disposed between members 172, 174, respectively, of valve bodies 148, 150 and valve members 152, 154. In particular, springs 156, 158 are seated within opposed spring seats formed in counterbores in valve body members 172, 174 and on outboard surfaces of valve members 152, 154. Springs 156, 158 surround pins 164, 166, respectively.

Pedestals 160, 162 support pins 164, 166 and enable adjustment of the position of pins 164, 166 along shuttle axis 142. Each pedestal 160, 162 is supported within a corresponding valve body 148, 150 and includes a head 180 and a threaded shank 182. Head 180 is configured to be received within the outboard portion of the through bore in a corresponding member 172, 174 of a valve body 148, 150. Head 180 may define a groove in a radially outer surface configured to receive a fluid seal disposed between head 180 and the radially inner surface of the through bore in member 172, 174 of valve body 148, 150. Each head 180 may further define a recess 184 configured to receive a tool used to adjust the position of pedestal 160, 162 (and therefore pin 164, 166) within valve bodies 148, 150 and along shuttle axis 142. Recess 184 may, for example, define one or more flats and may comprise a hexagonal recess configured to receive a hexagonal drive bit used to rotate pedestal 160, 162. It should be understood, however, that the form of recess 184 may vary to adapt to different tools including conventional screwdrivers. Shank 182 is configured to be received within the intermediate portion of the through bore in a corresponding member 172, 174 of a valve body 148, 150. Shank 182 may include a plurality of threads on a radially outer surface configured to engage corresponding threads formed on the surface of the bore to allow infinite positional adjustment of pedestals 160, 162 (and therefore pins 164, 166) along shuttle axis 142 upon rotation of pedestals 160, 162. Shank 182 further defines a blind bore configured to receive one end of a corresponding pin 164, 166 such that each of pins 164, 166 extends from one end of a corresponding pedestal 160, 162.

Pins 164, 166 provide a means for limiting movement of shuttle 98 along shuttle axis 142 towards check valves 100, 102. Pins 164, 166 limit the travel of shuttle 98 along shuttle axis 142 and, as a result, the travel of valve members 152, 154 along axis 142 caused by shuttle 98. Pins 142 are disposed about, and may be centered about, shuttle axis 142. One end of each pin 164, 166 is fixed to and supported by a corresponding pedestal 160, 162. The other end of each pin 164, 166 extends through a bore in a corresponding valve member 152, 154 and is configured for engagement with a corresponding end of shuttle 98. When shuttle 98 is forced towards one of check valves 100, 102 by fluid pressure within one of conduits 120, 122, shuttle 98 engages a corresponding valve member 152, 154 in the check valve 100, 102 and displaces the valve member 152, 154 along axis 142 to open the check valve 100, 102. The positions of pins 164, 166 determine the degree of travel by shuttle 98 along axis 142 and, therefore, the degree of travel by valve members 152, 154 along axis 142. Referring to FIG. 7, the degree of travel by valve members 152, 154 along axis 142 establishes the distance between shoulders 176 in members 168, 170 of valve bodies 148, 150 and shoulders 178 in valve members 152, 154 and, therefore, the size of fluid flow paths 144, 146. Therefore, the position of pins 164, 166 along axis 142 can be used to establish intermediate positions for valve member 152, 154 between the open and closed positions of valve members 152, 154 and a reduced fluid flow along fluid flow paths 144, 146 relative to the fluid flow that occurs when valve members 152, 154 are in the open position. This controlled reduction in fluid flow enables use of actuator 10 in a wider variety of applications including those in which loads acted upon by actuator 10 are also subject to external forces such as gravitational forces. Although check valves 100, 102 have been illustrated as having a similar construction, it should be understood that one of check valves 100, 102 could take on an alternative form and, in particular, omit means, such as pin 164 or 166, for limiting the movement of shuttle 98 along shuttle axis 142 in applications where it is only necessary to reduce fluid flow along one of fluid paths 144, 146. It should also be understood that either of pins 164, 166 can be positioned such that shuttle 98 is able to move the corresponding valve member 152, 154 to its (fully) open position in which the corresponding fluid flow path 144, 146 is at its maximum size or to any intermediate position between the (fully) open position and closed position in which the corresponding fluid flow path 144, 146 has a size less than its maximum size.

Figure 5:
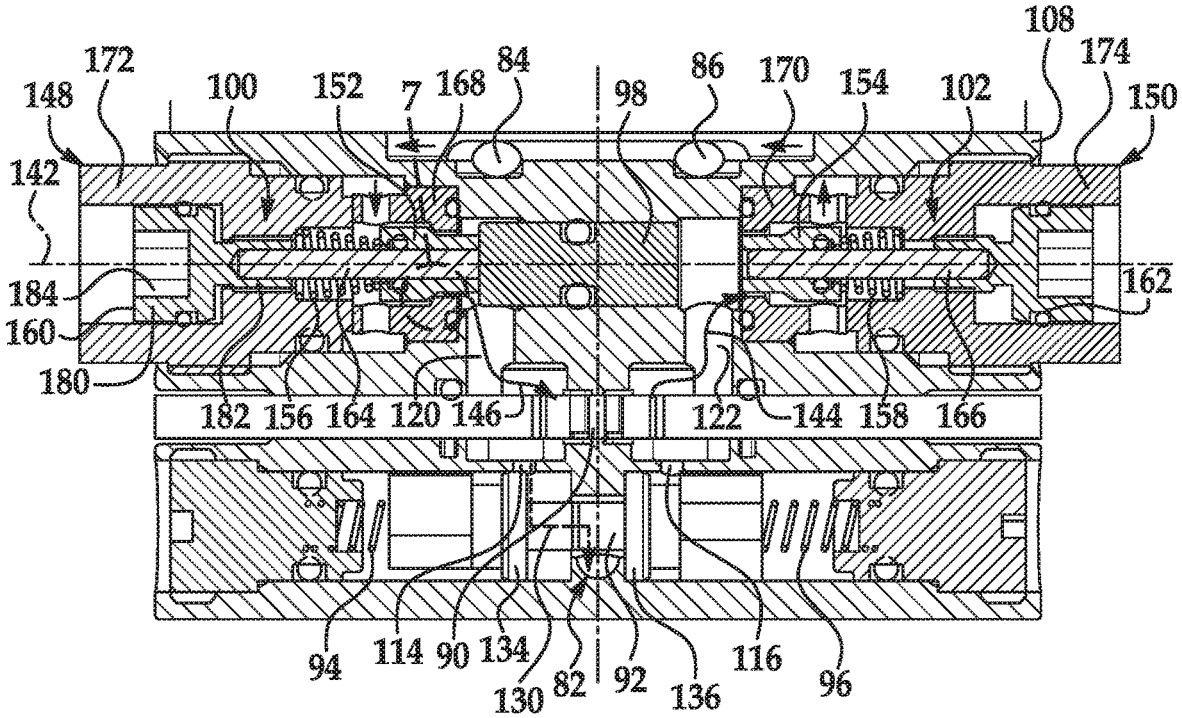
FIG. 5 is a cross-sectional view of the fluid pump of FIG. 3 illustrating operation of the fluid pump as the rod of the actuator is retracted.
Figure 6:
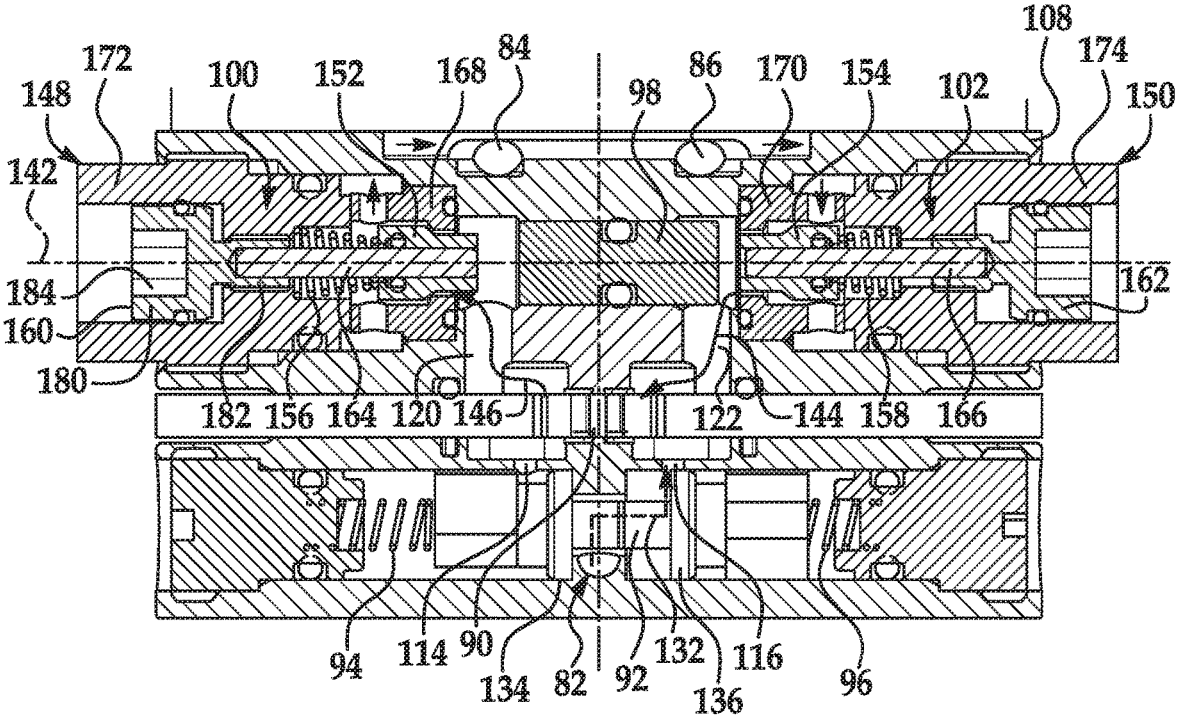
FIG. 6 is a cross-sectional view of the fluid pump of FIG. 3 illustrating operation of the fluid pump as the rod of the actuator is extended.

Referring now to FIGS. 3 and 5-6, the operation of pump 24 will be described in greater detail. FIG. 3 illustrates the state of pump 24 when the motor 22 and actuator 10 are at rest and the rod 20 of the actuator 10 is stationary (i.e. neither being extended or retracted). In this state, shuttle 92 is maintained at the neutral position by springs 94, 96 and the fluid flow paths 130, 132 (FIGS. 5 and 6) between inlet port 82 and ports 114, 116 are sealed. Springs 94, 96 maintain shuttle 92 at the neutral position despite gravitational forces thereby permitting actuator 10 to be used in more orientations than conventional devices. Shuttle 98 is likewise maintained at the neutral position and springs 156, 158 bias valve members 152, 154 against the valve seats formed in members 168, 170 of valve bodies 148, 150 to close check valves 100, 102.

FIG. 5 illustrates operation of pump 24 as rod 20 is being retracted. Motor 22 drives driven gear 88 in one rotational direction, causing rotation of idler gear 90 in the opposite rotational direction. Movement of gears 88, 90 pressurizes the fluid located in conduit 122 and port 116. The increasing fluid pressure in conduit 122 exerts a force on both shuttle 98 and valve member 154 in check valve 102. The fluid pressure on valve member 154 forces member 154 away from valve seat in member 170 of valve body 150 against the force of spring 158 to its open position thereby creating fluid flow path 144. At the same time, the fluid pressure on shuttle 98 moves shuttle 98 from its neutral position to the fluid flow position shown in FIG. 5. In this position, shuttle 98 forces valve member 152 away from the valve seat in member 168 of valve body 148 against the force of spring 156 thereby creating fluid flow path 146. The movement of shuttle 98, and therefore valve member 152, along axis 142 is limited by the position of pin 164. Depending on the position of pin 164, shuttle 98 may move valve member 152 to an open position where flow path 146 is at a maximum size or to an intermediate position where flow path 146 has less than the maximum size. Fluid flows along path 144 from the high pressure side of gears 88, 90 through conduit 122, member 170 of valve body 150 and outlet port 86 to portion 72 of chamber 16 to act against piston 18 and cause retraction of rod 20. At the same time, fluid is displaced from portion 70 of chamber 16 by movement of piston 18. This fluid travels along fluid flow path 146, entering pump 24 at outlet port 84, travelling through member 168 of valve body 148 and into conduit 120. The increasing fluid pressure in port 116 from rotation of gears 88, 90 also exerts a force on shuttle 92 that forces shuttle 92 to move from its neutral position to the fluid flow position shown in FIG. 5. In this position, shuttle 92 prevents leakage of fluid back to inlet port 82 and reservoir 32 from the high pressure side of the pump 24. At the same time, shuttle 92 opens fluid flow path 130 from port 114 to inlet port 82. Because of the presence of rod 20 on one side of piston 18, retraction of rod 20 results in an overall decrease in fluid volume within fluid chamber 16. A portion of the fluid displaced from chamber 16 will ultimately return to reservoir 32 along path 130. The remainder is regenerated by pump 24 and transferred from portion 70 of chamber 16 to portion 72 of chamber 16. The fluid returning to reservoir 32 travels along fluid flow path 130 from port 114 to inlet port 82. As discussed hereinabove with reference to FIGS. 1-2, reservoir 32 expands through movement of lid 46 in response to the pressure of returning fluid in order to accommodate the increase in fluid volume. Once the rod 20 has reached a predetermined position, the motor 22 halts rotation of gears 88, 90. The labyrinth seal around portion 134 of shuttle 92 will slowly leak fluid reducing fluid pressure in cavity 112, conduits 120, 122 and ports 114, 116. In the absence of the fluid pressure, springs 158, 160 bias valve members 152, 154 against the valve seats in members 168, 170 of valve bodies 148, 150 to close check valves 100, 102, shuttle 98 returns to the neutral position (FIG. 3) and springs 94, 96 return shuttle 92 to its neutral position (FIG. 3).

FIG. 6 illustrates operation of pump 24 as rod 20 is being extended. Motor 22 drives driven gear 88 in the opposite rotational direction relative to the operation of the pump 24 illustrated in FIG. 5. Rotation of driven gear 88 again causes rotation of idler gear 90 in the opposite rotational direction relative to driven gear 88. Movement of gears 88, 90 pressurizes the fluid located in conduit 120 and port 114. The increasing fluid pressure in conduit 120 exerts a force on both shuttle 98 and valve member 152 in check valve 100. The fluid pressure on valve member 152 forces valve member 152 away from the valve seat in member 168 of valve body 148 against the force of spring 156 thereby creating fluid flow path 146. At the same time, the fluid pressure on shuttle 98 moves shuttle 98 from its neutral position to the fluid flow position shown in FIG. 6. In this position, shuttle 98 forces valve member 154 away from the valve seat in member 150 of valve body 170 against the force of spring 158 thereby creating fluid flow path 144. Fluid flows along path 146 from the high pressure side of gears 88, 90 through conduit 120, member 148 of valve body 168 and through outlet port 84 to portion 70 of chamber 16 to act against piston 18 and cause extension of rod 20. At the same time, fluid is displaced from portion 72 of chamber 16 by movement of piston 18. This fluid travels along fluid flow path 144, entering pump 24 at outlet port 94, travelling through member 150 of valve body 170, and into conduit 122. The increasing fluid pressure in port 114 from rotation of gears 88, 90 also exerts a force on shuttle 92 that forces shuttle 92 to move from its neutral position to the fluid flow position shown in FIG. 6. In this position, shuttle 92 prevents leakage of fluid back to inlet port 82 and reservoir 32 from the high pressure side of the pump 24. At the same time, shuttle 92 opens fluid flow path 132 from port 116 to inlet port 82. Because of the presence of rod 20 on one side of piston 18, extension of rod 20 results in an overall increase in fluid volume within fluid chamber 16. Fluid is regenerated by pump 24 and transferred from portion 72 of chamber 16 to portion 70 of chamber 16. Additional fluid is drawn from reservoir 32 and travels along fluid flow path 132 from inlet port 82 to port 116. As discussed hereinabove with reference to FIGS. 1-2, reservoir 32 contracts through movement of lid 46 in response to springs 48 with the decrease in fluid pressure in reservoir 32 in order to accommodate the decrease in fluid volume. Once the rod 20 has reached a predetermined position, the motor 22 halts rotation of gears 88, 90. The labyrinth seal around portion 136 of shuttle 92 will slowly leak fluid reducing fluid pressure in cavity 112, conduits 120, 122 and ports 114, 116. In the absence of the fluid pressure, springs 156, 158 bias valve members 152, 154 against the valve seats in members 168, 170 of valve bodies 148, 150 to close valves 100, 102, shuttle 98 returns to the neutral position (FIG. 3) and springs 94, 96 return shuttle 92 to its neutral position (FIG. 3).

A fluid pump 24 in accordance with the present teachings is advantageous relative to conventional fluid pumps for linear actuators. The valve structure 100, 102 of the fluid pump 24 allows adjustment of fluid flow without adding or removing any parts in the pump 24. Pumps using orifice plates to meter fluid flow must be disassembled to exchange orifice plates of different sizes or to move the orifice plate in order to change the degree of metering of fluid flow. Further, unlike orifice plates, the valve structure 100, 102 of the fluid pump 24 disclosed herein is able to maintain the size of the fluid flow path 144, 146 despite localized heating while meting fluid flow. The larger mass and surface area of the valve 100, 102 decreases the rate of heating and also reduces the amount of time required for transferring heat out of the valve 100, 102. The bi-directional nature of the fluid pump 24 disclosed herein also reduces or eliminates the potential flor clogs to develop. Unlike adjustable needle valves, the valve structure 100, 102 of the fluid pump 24 is able to meter fluid flow while maintaining a single fluid flow path 144, 146. Finally, unlike counterbalance valves, the valve structure 100, 102 of the fluid pump 24 requires relatively little space and is relatively inexpensive.

While the invention has been shown and described with reference to one or more particular embodiments thereof, it will be understood by those of skill in the art that various changes and modifications can be made without departing from the spirit and scope of the invention.

I claim:

1. A fluid pump for a linear actuator, comprising:

a housing defining an inlet port configured for fluid communication with a fluid reservoir and first and second outlet ports configured for fluid communication with first and second portions of a fluid chamber formed on opposite sides of a piston disposed within the fluid chamber;

a driven pump element disposed within the housing;

a first check valve configured to control fluid flow between the driven pump element and the first outlet port;

a second check valve configured to control fluid flow between the driven pump element and the second outlet port;

a first shuttle disposed between the first check valve and the second check valve and movable along a shuttle axis extending through the first check valve and the second check valve responsive to fluid pressure in the housing;

wherein the first check valve includes a valve member movable between a closed position and an open position defining a fluid flow path between the driven pump element and the first outlet port and a pin extending along the shuttle axis through a bore in the first valve member and configured for engagement with the first shuttle, rotation of the driven pump element in a first rotational direction establishing a first fluid pressure causing the valve member to move from the closed position to the open position and rotation of the driven pump element in a second rotational direction establishing a second fluid pressure causing the first shuttle to move the valve member from the closed position to one of the open position and an intermediate position between the closed position and the open position responsive to a position of the pin along the shuttle axis wherein the first check valve further includes a body supported within the housing and a pedestal supported within the body and supporting the pin, the pedestal movable within the body along the shuttle axis to adjust the position of the pin along the shuttle axis.

2. The fluid pump of claim 1 wherein fluid flow through the fluid flow path between the driven pump element and first outlet port is greater when the valve member is in the open position than when the valve member is in the intermediate position.

3. The fluid pump of claim 1 wherein the pedestal includes a first plurality of threads configured to engage a second plurality of threads in the body.

4. The fluid pump of claim 1 wherein the pin extends from a first end of the pedestal and a second end of the pedestal defines a recess configured to receive a tool for adjusting a position of the pedestal within the body.

5. The fluid pump of claim 1 wherein the first check valve further includes a spring disposed between the body and the valve member and biasing the valve member towards the closed position, the spring surrounding the pin.

6. The fluid pump of claim 1 wherein the second check valve includes a valve member movable between a closed position and an open position defining a fluid flow path between the driven pump element and the second outlet port and a pin extending along the shuttle axis through a bore in the second valve member and configured for engagement with the first shuttle, the second fluid pressure causing the valve member of the second check valve to move from the closed position to the open position and the first fluid pressure causing the first shuttle to move the valve member of the second check valve from the closed position to one of the open position and an intermediate position between the closed position and the open position responsive to a position of the pin of the second check valve along the shuttle axis.

7. The fluid pump of claim 1, further comprising a second shuttle movable between a first fluid flow position permitting fluid flow between the inlet port and the driven pump element along a first fluid flow path and a second fluid flow position permitting fluid flow between the inlet port and the driven pump element along a second fluid flow path;

wherein rotation of the driven pump element in the first rotational direction results in movement of the second shuttle to the first fluid flow position and rotation of the driven pump element in the second rotational direction results in movement of the second shuttle to the second fluid flow position.

8. The fluid pump of claim 7 further comprising first and second springs disposed on opposite sides of the second shuttle and biasing the second shuttle to a neutral position different from the first and second fluid flow positions.

9. The fluid pump of claim 8 wherein the second shuttle inhibits fluid flow along the first and second fluid flow paths when in the neutral position.

10. A fluid pump for a linear actuator, comprising:

a housing defining an inlet port configured for fluid communication with a fluid reservoir and first and second outlet ports configured for fluid communication with first and second portions of a fluid chamber formed on opposite sides of a piston disposed within the fluid chamber;

a driven pump element disposed within the housing;

a first check valve configured to control fluid flow between the driven pump element and the first outlet port;

a second check valve configured to control fluid flow between the driven pump element and the second outlet port;

a first shuttle disposed between the first check valve and the second check valve and movable along a shuttle axis extending through the first check valve and the second check valve responsive to fluid pressure in the housing;

wherein the first check valve includes a valve member movable between a closed position and an open position defining a fluid flow path between the driven pump element and the first outlet port and means for limiting movement of the first shuttle in a first direction along the shuttle axis towards the first check valve, rotation of the driven pump element in a first rotational direction establishing a first fluid pressure causing the valve member to move from the closed position to the open position and rotation of the driven pump element in a second rotational direction establishing a second fluid pressure causing the first shuttle to move in the first direction along the shuttle axis and move the valve member from the closed position to one of the open position and an intermediate position between the closed position and the open position responsive to a position of the limiting means along the shuttle axis wherein the first check valve further includes a body supported within the housing and a pedestal supported within the body and supporting the limiting means, the pedestal movable within the body along the shuttle axis to adjust the position of the limiting means along the shuttle axis.

11. The fluid pump of claim 10 wherein fluid flow through the fluid flow path between the driven pump element and first outlet port is greater when the valve member is in the open position than when the valve member is in the intermediate position.

12. The fluid pump of claim 10 wherein the pedestal includes a first plurality of threads configured to engage a second plurality of threads in the body.

13. The fluid pump of claim 10 wherein the limiting means extends from a first end of the pedestal and a second end of the pedestal defines a recess configured to receive a tool for adjusting a position of the pedestal within the body.

14. The fluid pump of claim 10 wherein the first check valve further includes a spring disposed between the body and the valve member and biasing the valve member towards the closed position, the spring surrounding the limiting means.

15. The fluid pump of claim 10 wherein the second check valve includes a valve member movable between a closed position and an open position defining a fluid flow path between the driven pump element and the second outlet port and means for limiting movement of the first shuttle in a second direction along the shuttle axis towards the second check valve, the second fluid pressure causing the valve member of the second check valve to move from the closed position to the open position and the first fluid pressure causing the first shuttle to move in the second direction along the shuttle axis and move the valve member of the second check valve from the closed position to one of the open position and an intermediate position between the closed position and the open position responsive to a position of the limiting means of the second check valve along the shuttle axis.

16. The fluid pump of claim 10, further comprising a second shuttle movable between a first fluid flow position permitting fluid flow between the inlet port and the driven pump element along a first fluid flow path and a second fluid flow position permitting fluid flow between the inlet port and the driven pump element along a second fluid flow path;

wherein rotation of the driven pump element in the first rotational direction results in movement of the second shuttle to the first fluid flow position and rotation of the driven pump element in the second rotational direction results in movement of the second shuttle to the second fluid flow position.

17. The fluid pump of claim 16 further comprising first and second springs disposed on opposite sides of the second shuttle and biasing the second shuttle to a neutral position different from the first and second fluid flow positions.

18. The fluid pump of claim 17 wherein the second shuttle inhibits fluid flow along the first and second fluid flow paths when in the neutral position.

19. A linear actuator, comprising:

a tube defining a fluid chamber;

a piston disposed within the fluid chamber;

a pushrod coupled to the piston for movement with the piston;

a fluid pump including a housing defining an inlet port configured for fluid communication with a fluid reservoir and first and second outlet ports configured for fluid communication with first and second portions of a fluid chamber formed on opposite sides of a piston disposed within the fluid chamber;

a driven pump element disposed within the housing;

a first check valve configured to control fluid flow between the driven pump element and the first outlet port;

a second check valve configured to control fluid flow between the driven pump element and the second outlet port;

a first shuttle disposed between the first check valve and the second check valve and movable along a shuttle axis extending through the first check valve and the second check valve responsive to fluid pressure in the housing; and, a motor coupled to the driven pump element wherein the first check valve includes a valve member movable between a closed position and an open position defining a fluid flow path between the driven pump element and the first outlet port and a pin extending along the shuttle axis through a bore in the first valve member and configured for engagement with the first shuttle, rotation of the driven pump element in a first rotational direction establishing a first fluid pressure causing the valve member to move from the closed position to the open position and rotation of the driven pump element in a second rotational direction establishing a second fluid pressure causing the first shuttle to move the valve member from the closed position to one of the open position and an intermediate position between the closed position and the open position responsive to a position of the pin along the shuttle axis wherein the first check valve further includes a body supported within the housing and a pedestal supported within the body and supporting the pin, the pedestal movable within the body along the shuttle axis to adjust the position of the pin along the shuttle axis.

20. The linear actuator of claim 19 wherein the pin extends from a first end of the pedestal and a second end of the pedestal defines a recess configured to receive a tool for adjusting a position of the pedestal within the body.

21. The linear actuator of claim 19 wherein the first check valve further includes a spring disposed between the body and the valve member and biasing the valve member towards the closed position, the spring surrounding the pin.

* * * * *